US012751502B2

(12) United States Patent
Nelson

(10) Patent No.: US 12,751,502 B2
(45) Date of Patent: Oct. 6, 2026

(54) MALE UNDERGARMENT

(71) Applicant: Undyz LLC, Las Vegas, NV (US)

(72) Inventor: Alyxander L Nelson, Las Vegas, NV (US)

(73) Assignee: Undyz LLC, Las Vegas, NV (US)

( * ) Notice: Subject to any disclaimer, the term of this patent is extended or adjusted under 35 U.S.C. 154(b) by 0 days.

(21) Appl. No.: 19/067,876

(22) Filed: Mar. 1, 2025

(65) Prior Publication Data

US 2025/0280899 A1 Sep. 11, 2025

Related U.S. Application Data

(60) Provisional application No. 63/561,367, filed on Mar. 5, 2024.

(51) Int. Cl.
*A41B 9/00* (2006.01)

(52) U.S. Cl.
CPC ..... *A41B 9/004* (2013.01)

(58) Field of Classification Search
CPC ..... A41B 9/004; A41B 9/007; A41B 9/02; A41B 9/023; A41B 2300/324; A41D 1/065
USPC ..... 2/405
See application file for complete search history.

(56) References Cited

U.S. PATENT DOCUMENTS 4,068,315 A * 1/1978 Rainville ..... A41D 13/1254 2/919
4,280,230 A * 7/1981 LaFleur ..... A61F 13/70 2/408
5,636,387 A * 6/1997 Lundy ..... A61F 5/0096 2/406
7,000,261 B1 * 2/2006 Loffredo ..... A61F 5/449 2/400
7,032,249 B2 * 4/2006 Smith ..... A41D 1/08 2/407
8,087,098 B2 * 1/2012 Kimberly ..... A41B 9/001 2/403
2005/0177931 A1 * 8/2005 Tsujimoto ..... A63B 71/1216 2/466
2014/0047620 A1 * 2/2014 Ingalls ..... A41B 9/02 2/403

* cited by examiner

*Primary Examiner* — Timothy K Trieu
(74) *Attorney, Agent, or Firm* — QuickPatents; Kevin Prince

(57) ABSTRACT

An advanced undergarment is designed specifically for human males, aiming to significantly enhance comfort and support while addressing the common issues of chafing and inadequate ventilation associated with traditional undergarments. A fabric web includes a top edge with a curved portion to create an open frontal area and leg apertures. The curved portions prevent the scrotum from contacting the thighs, thus reducing chafing. The undergarment incorporates a first and a second gusset web, providing additional frontal volume for unconstrained male genitalia. An elastic waistband and two fitted leg hems ensure a secure fit without restricting movement. Furthermore, a sizing undergarment can be used having adjustable straps, including waist, leg, and thigh adjustment straps, allowing for a customizable fit for various body sizes and shapes. This invention represents a significant advancement in male undergarment design, offering unparalleled comfort, support, and adjustability.

14 Claims, 5 Drawing Sheets

MALE UNDERGARMENT

CROSS REFERENCE TO RELATED APPLICATIONS

This application claims the benefit of U.S. Provisional Patent Application 63/561,367, filed on Mar. 5, 2024, and incorporated herein by reference.

STATEMENT REGARDING FEDERALLY SPONSORED RESEARCH AND DEVELOPMENT

Not Applicable.

FIELD OF THE INVENTION

This invention relates to undergarments, and more particularly to an undergarment for males that isolates the genitalia from contacting the thighs.

BACKGROUND

In the realm of men's undergarments, traditional designs have long been the standard, offering a basic level of comfort and functionality. However, these conventional designs often fall short in addressing specific needs related to comfort, support, and the prevention of common issues such as chafing and inadequate ventilation. One of the most significant drawbacks of prior art is the lack of effective isolation between the scrotum and the thighs. This oversight leads to discomfort and the potential for skin irritation, particularly in warm climates or during physical activity.

Moreover, prior art undergarments typically employ designs that restrict the mobility of the male genitalia, using pockets, gussets, or compartments. While these elements aim to provide support, they often result in a constricted feeling, limiting the wearer's comfort and freedom of movement. This approach highlights a fundamental flaw in the design philosophy of existing products.

Given these limitations, there is a clear need for an innovative undergarment that not only addresses the issues of chafing and ventilation but also offers a design that allows the male genitalia to remain unconstrained. An ideal invention would feature an inner barrier that effectively separates the scrotum from the thighs without resorting to restrictive compartments. Additionally, a sizing undergarment with adjustable features could be employed to ensure a perfect fit for various body shapes and sizes, thereby eliminating problems related to tightness, folding fabric, and discomfort. The sizing undergarment could be used to customize such undergarments for particular wearers. The envisioned product would represent a significant departure from the closed design philosophy of prior art, adopting an open approach that prioritizes comfort, support, and freedom of movement. The present invention accomplishes these objectives.

SUMMARY OF THE INVENTION

The present invention is an undergarment designed specifically for human males, structured to significantly enhance the wearer's comfort and support. It addresses common issues such as chafing and inadequate ventilation, which are prevalent with traditional undergarments.

A fabric web is designed to be both flexible and breathable. It features a top edge that includes a curved portion, creating an open frontal area. The curved portions contact the wearer at the top of the thigh, preventing the scrotum from making contact with the thighs, thereby reducing the risk of chafing. The fabric web is also designed with leg apertures, formed by joining side edges with inseam edges, which further contribute to the undergarment's comfort and functionality.

Additionally, the undergarment may incorporate a first and a second gusset web. These gusset webs are attached to the fabric web and provide a frontal volume that allows the male genitalia to be unconstrained, enhancing the wearer's comfort.

To ensure a secure and customizable fit, the undergarment may be equipped with a nylon-elastane or similar material waistband designed to secure the undergarment in place without restricting movement. Furthermore, a sizing undergarment similar to the undergarment may feature several adjustment straps, including a waist adjustment strap, leg adjustment straps, and thigh adjustment straps. These straps allow the wearer to adjust the undergarment at various points, accommodating a wide range of body sizes and shapes, and ensuring an optimal fit. The adjustments made on the sizing undergarment are then used to manufacture the undergarment with customized measurements and sent to the customer.

Overall, this invention and sizing method represents a significant advancement in the design of male undergarments, offering a combination of comfort, support, and adjustability that addresses the limitations of existing products in the market.

The present invention significantly improves upon the existing designs of men's undergarments by providing a solution that prevents the scrotum from contacting the thighs, reducing chafing and improving air flow. Unlike the restrictive designs of the past, this invention uses a design that allows for freedom of movement of the male genitalia. It also features a sizing undergarment with adjustable straps for the waist, thigh, and mid-thigh, enabling a custom fit for different body sizes and shapes from which to manufacture custom sized undergarments. This addresses common issues such as tightness and fabric bunching, enhancing overall comfort. By addressing the limitations of previous designs with its straightforward and functional approach, the invention offers a practical improvement in men's undergarments, focusing on comfort, support, customization, and mobility. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element. When the words "substantially" or "about" are used, if a quantitative measurement is necessary, within 95% of "complete" or "exact" should be considered the meaning. The term "the invention" or "the present invention" should always be construed as "an embodiment of the invention."

FIGS. 1-5 illustrate an undergarment 10 specifically designed for a human male wearer 20. This undergarment 10 is structured to enhance the wearer's comfort and support, particularly focusing on the male genitalia, while also addressing issues such as chafing and inadequate ventilation. The detailed description below, with references to the accompanying figures, outlines the structure and assembly of the undergarment 10.

Figure 1:
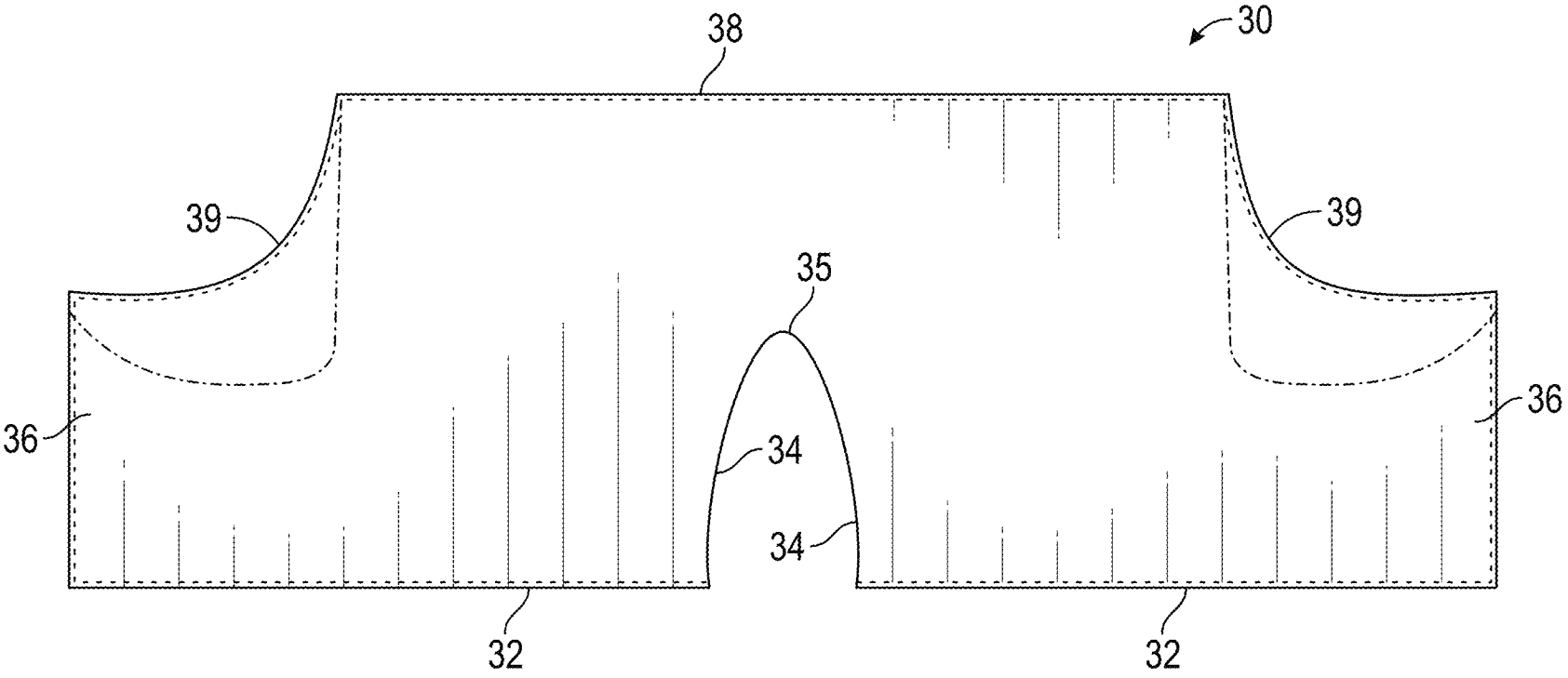
FIG. 1 is a front elevational view of a fabric web of an undergarment of the invention, illustrated in a flat configuration.

A fabric web 30 of the undergarment 10, as shown in FIG. 1, is presented in a flat configuration. This fabric web 30 is constructed from materials such as cotton, modal, or a cotton-elastane blend, chosen for their flexibility and breathability. It features a top edge 38, a bottom edge 32, two opposing inseam edges 34 converging at an apex 35, and two opposing side edges 36. The top edge 38 includes a curved portion 39, designed to create an open frontal area 31, which allows the wearer's genitalia to be relatively unconstrained.

Figure 2A:
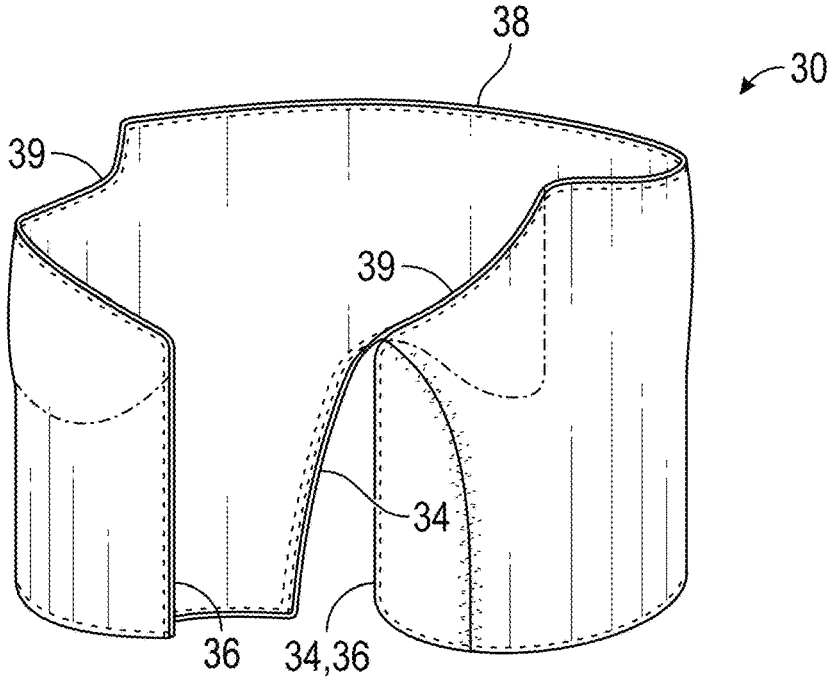
FIG. 2A is a perspective view of the fabric web shown with one side edge thereof fixed with an inseam edge thereof, and with an opposing side edge being moved towards an opposing inseam edge.
Figure 2B:
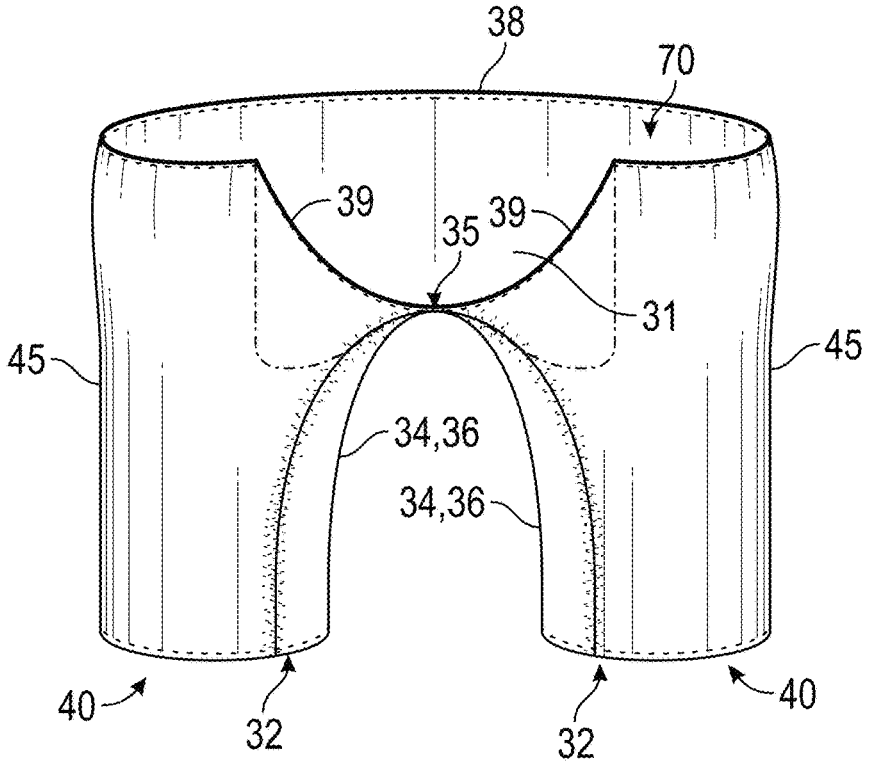
FIG. 2B is a front perspective view of both side edges of the fabric web fixed with their corresponding inseam edges, and further showing attachment lines for a pair of gusset webs.

The formation of the leg apertures 40 begins with one side edge 36 of the fabric web 30 being joined to an inseam edge 34, as illustrated in FIG. 2A. The opposing side edge 36 is then brought towards the opposing inseam edge 34. FIG. 2B shows both side edges 36 of the fabric web 30 joined with their respective inseam edges 34, thus forming the leg apertures 40. This figure also indicates the points of attachment for gusset webs 50, 80.

Figure 3A:
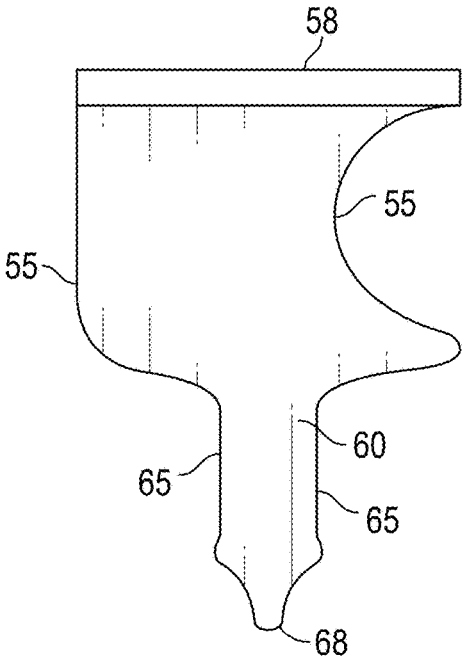
FIG. 3A is a front elevational view of a first gusset web, illustrated in a flat configuration.
Figure 3B:
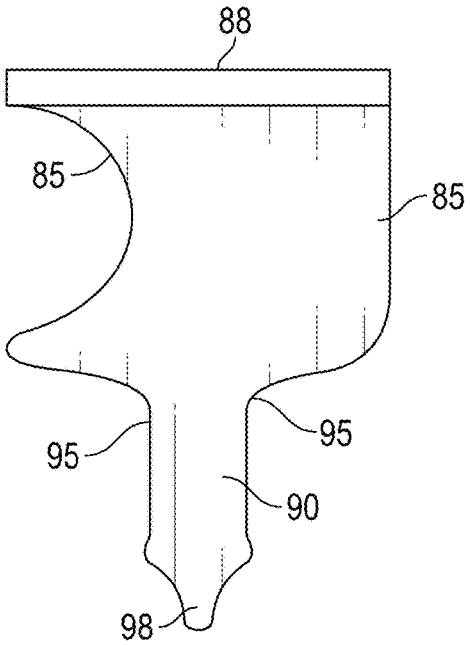
FIG. 3B is a front elevational view of a second gusset web, illustrated in a flat configuration.

The first gusset web 50 and the second gusset web 80 are depicted in a flat configuration in FIGS. 3A and 3B, respectively. These gusset webs 50, 80 are made from the same or similar materials as the fabric web 30. Each gusset web 50, 80 has a top edge 58, 88, an elongated bottom strap 60, 90 with two opposing bottom strap side edges 65, 95, and two side edges 55, 85.

Figure 3C:
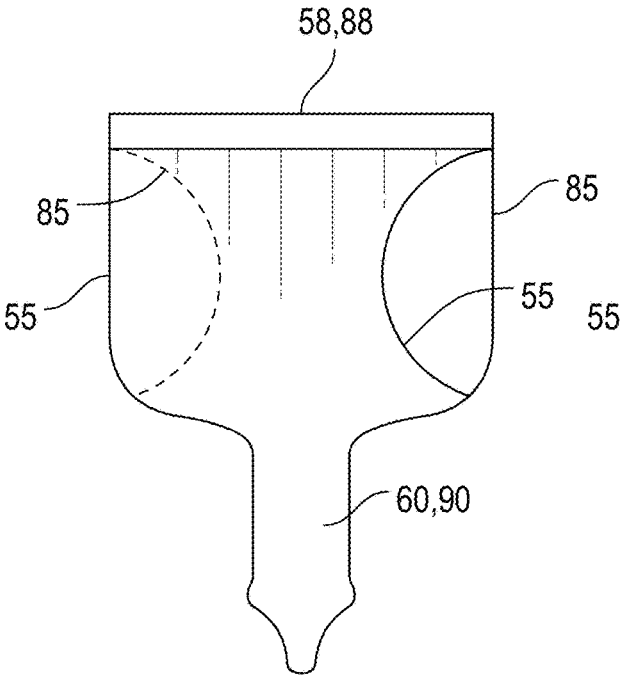
FIG. 3C is a front elevational view of the first and second gusset webs mutually fastened before attachment to the fabric web.
Figure 3D:
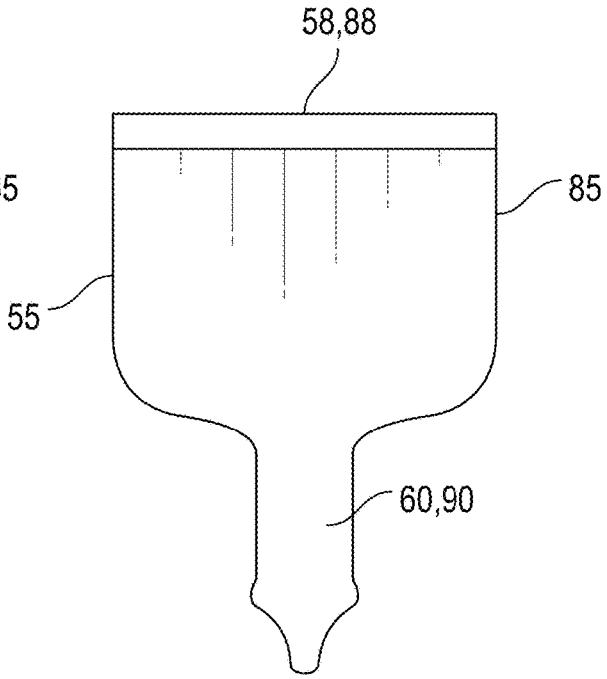
FIG. 3D is a front elevational view of the first gusset web fastened to the fabric web with no openings.
Figure 4:
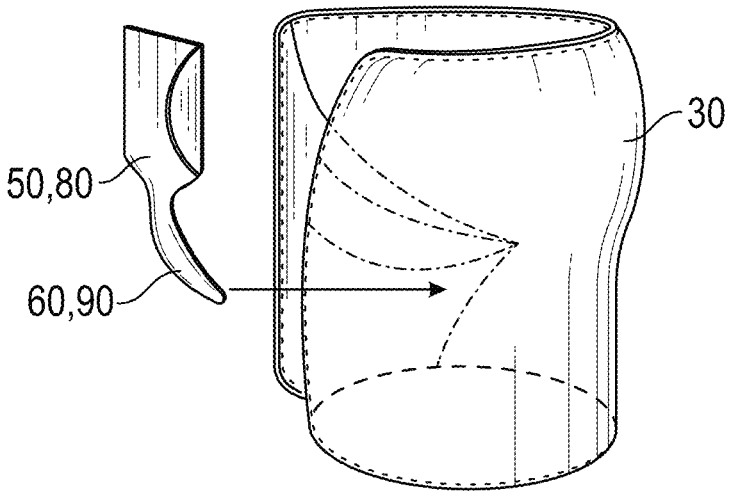
FIG. 4 is a side perspective view of the first and second gusset webs as being attached to the fabric web.

FIG. 3C illustrates an embodiment wherein the first and second gusset webs 50, 80 fastened together prior to being attached to the fabric web 30, demonstrating how they form a unified structure that provides a frontal volume 100. FIG. 3D illustrates an embodiment wherein only the first gusset web 50 fastened to the fabric web 30 without any opening. The attachment process of the gusset webs 50, 80 to the fabric web 30 is shown in FIG. 4. This step is for integrating the gusset webs 50, 80 with the fabric web 30 to ensure the undergarment's 10 functionality.

Figure 5:
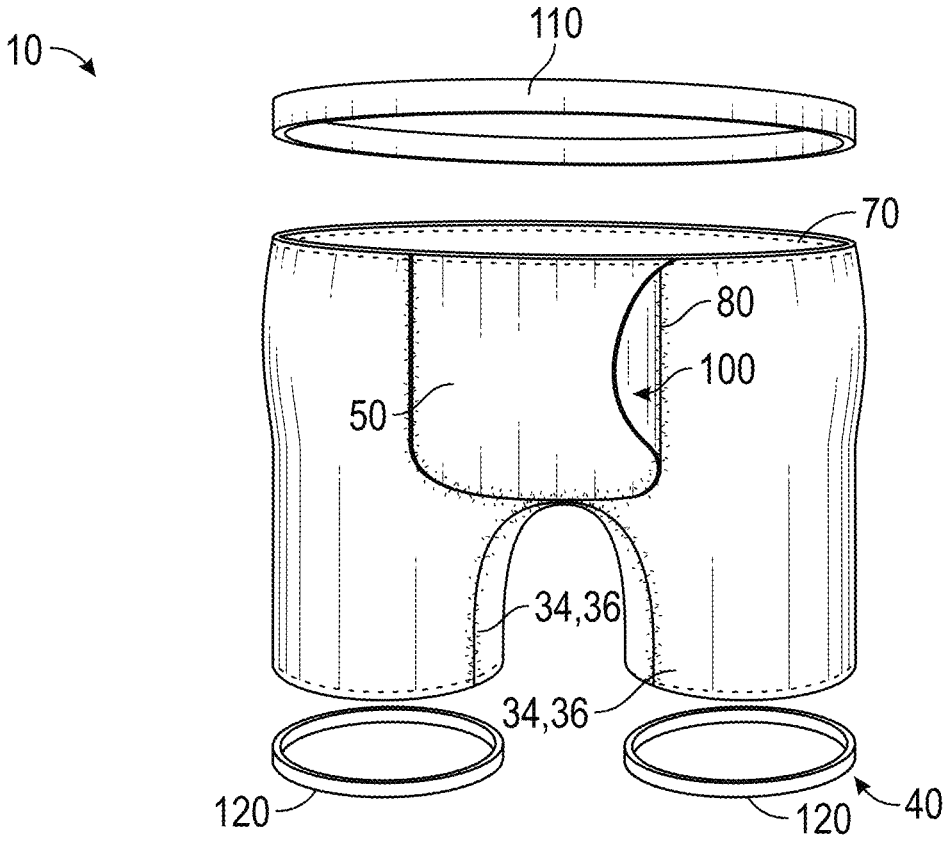
FIG. 5 is a front perspective view of undergarment, illustrated with an elastic waistband and two leg hems being affixed therewith.

An elastic waistband 110 and two leg hems 120 are affixed to the undergarment 10, as seen in FIG. 5. The elastic waistband 110, composed of a nylon-elastane blend or the like, encircles the waist aperture 70, offering a secure fit. The leg hems 120, made from similar materials, are attached around each leg aperture 40, securing the undergarment 10 in place without restricting movement.

Figure 7:
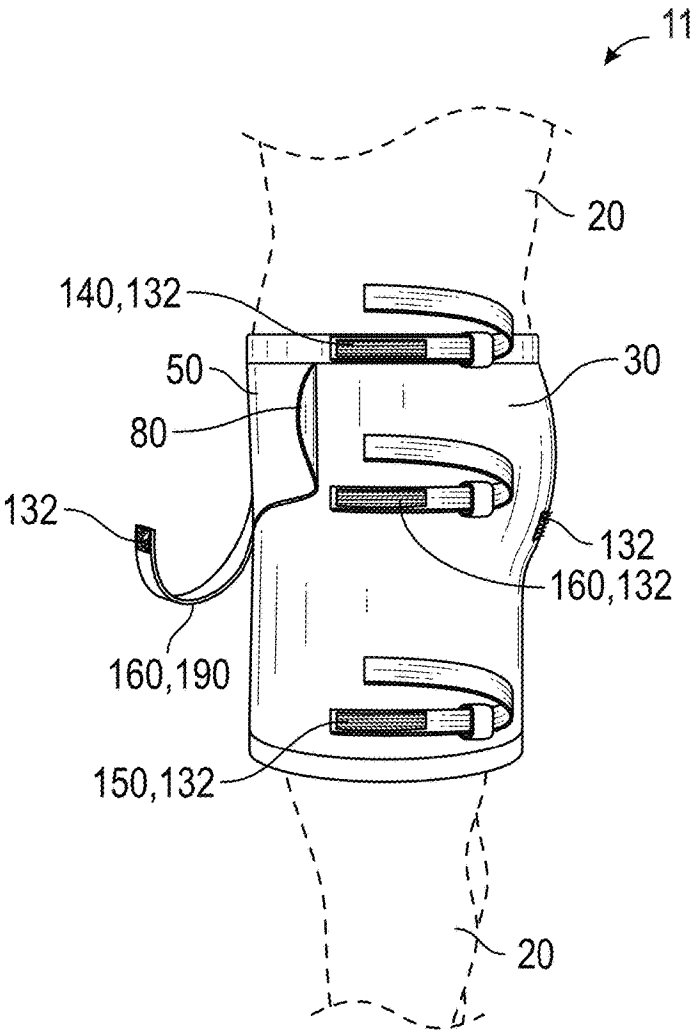
FIG. 7 is a side perspective view of the sizing undergarment of FIG. 6.
Figure 6:
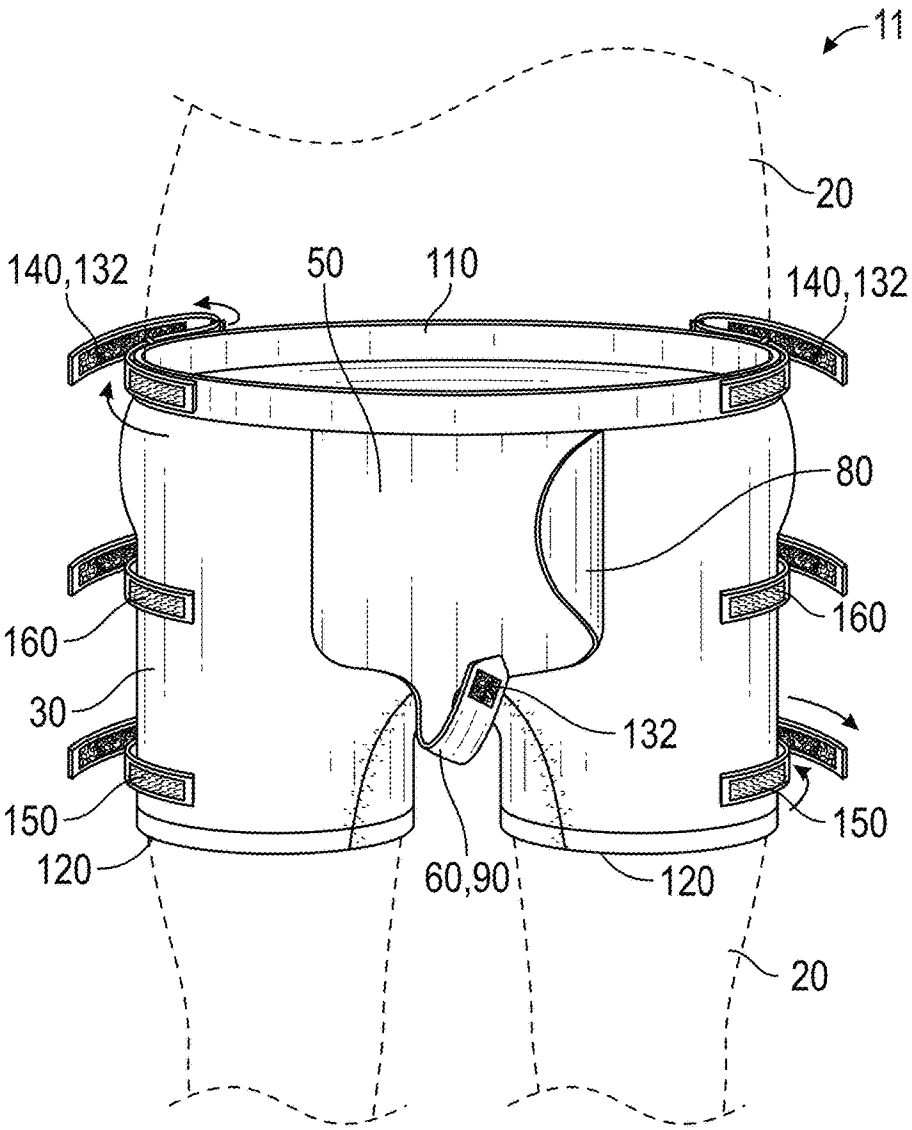
FIG. 6 is a front perspective view showing a plurality of adjustment bands of a sizing undergarment of the invention.

In FIGS. 6 and 7, a sizing undergarment 11 is depicted with several adjustment straps, each designed to enhance the fit and comfort for the wearer 20. These adjustment straps are integral to the sizing undergarment's 11 design, allowing for customization to accommodate various body shapes and sizes. The adjustments made on the sizing undergarment can be used to customize undergarment measurements for the wearer 20. Measurement indicia (not shown) may be included on any of the adjustment straps to facilitate an understanding of the requirement measurements for customization of the undergarments to be manufactured.

A waist adjustment strap 140 is included as part of the elastic waistband 110. This strap 140 includes a loop and a hook-and-loop type fastening material 132, enabling the wearer 20 to adjust the size of the waist aperture 70. Made from durable materials, the waist adjustment strap 140 ensures that the sizing undergarment 11 can be snugly fitted around the waist, providing a comfortable and secure fit without being overly tight or restrictive.

Each leg hem 120 incorporates a leg adjustment strap 150. Like the waist adjustment strap 140, these leg adjustment straps 150 also feature a loop and a hook-and-loop type fastening material 132. They allow for the size of each leg aperture 40 to be adjusted independently, ensuring a close fit that prevents the sizing undergarment 11 from riding up or becoming uncomfortable during movement. The leg adjustment straps 150 are designed to be easily accessible and adjustable, providing the wearer 20 with the ability to customize the fit around each leg aperture 40 according to personal preference, comfort needs, or needs based on particular common activities.

Additionally, the sizing undergarment 11 includes two opposing thigh adjustment straps 160. These straps 160, equipped with a loop and a hook-and-loop type fastening material 132, are fixed to the fabric web 30 at side thigh areas 45, opposite the leg aperture 40 from the apex 35 of the inseam edges 34. This placement allows for the size of each side thigh area 45 to be adjusted, offering additional customization for the wearer 20. The thigh adjustment straps 160 are particularly useful for adapting the fit of sizing undergarment 11 around the upper legs, ensuring comfort and reducing the risk of chafing or discomfort in this sensitive area.

The inclusion of the waist adjustment strap 140, leg adjustment straps 150, and thigh adjustment straps 160 in the design of the sizing undergarment 11, facilitates a customizable and comfortable fit. By allowing the wearer 20 to adjust the sizing undergarment 11 at the waist, legs, and thighs, the design accommodates a wide range of body sizes and shapes, enhancing the overall wearing experience. Once the wearer has adjusted all of the adjustment straps on the sizing undergarment 11, the sizing undergarment 11 can be used to custom manufacture one or more of the undergarments for the wearer 20.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An undergarment for a human male wearer, comprising:

a fabric web having a top edge, a bottom edge, two opposing inseam edges meeting at an apex, and two opposing side edges, the top edge curved at a curved portion downwardly towards the bottom edge at each of the side edges to form an open frontal area having two upper corners; each side edge sewn to one of the inseam edges to form a leg aperture;

a first gusset web having a first gusset top edge, a first gusset elongated bottom strap having two opposing bottom strap side edges and a bottom strap distal end, and two first gusset side edges each defining an upper corner at the first gusset top edge, the upper corners of the first gusset top edge each fixed with one of the upper corners of the fabric web to form a continuous waist aperture, one of the first gusset side edges fixed with one of the inseam edges of the fabric web, the opposing first gusset side edge left unattached;

a second gusset web having a second gusset top edge, a second gusset elongated bottom strap having two opposing bottom strap side edges and a bottom strap distal end, and two second gusset side edges each defining an upper corner at the second gusset top edge, the upper corners of the second gusset web each fixed with one of the upper corners of the fabric web and the first gusset web as part of the continuous waist aperture, one of the second gusset side edges fixed with one of the inseam edges of the fabric web, the opposing second gusset side edge left unattached, the unattached first gusset side edge being opposite the unattached second gusset side edge;

the bottom strap distal end of each gusset web mutually affixed to the fabric web proximate the apex of the fabric web;

whereby when worn by the wearer, the curved portion of the fabric web isolate the wearer's scrotum from contacting his thighs, the first gusset and the second gusset providing a frontal volume forward of the open frontal area of the fabric web that allows the wearer's genitalia to be unconstrained.

2. The undergarment of claim 1 further including an elastic waistband fixed around the waist aperture.

3. The undergarment of claim 2 wherein the elastic waistband includes a waist adjustment strap that includes a loop and a hook-and-loop type fastening material, whereby a size of the waist aperture may be adjusted.

4. The undergarment of claim 1 further including a flexible hem fixed around each leg aperture.

5. The undergarment of claim 2 further including a flexible leg hem fixed around each leg aperture.

6. The undergarment of claim 4 wherein each leg hem includes a leg adjustment strap that includes a loop and a hook-and-loop type fastening material, whereby a size of each leg aperture may be adjusted.

7. The undergarment of claim 1 wherein the unattached side edge of each gusset web is curved inwardly.

8. The undergarment of claim 1 wherein the bottom strap distal end of each gusset web is mutually and adjustably affixed to the fabric web proximate the apex of the fabric web with an attachment mechanism, proximate the wearer's perineum.

9. The undergarment of claim 8 wherein the attachment mechanism includes a mechanical snap fastener.

10. The undergarment of claim 8 wherein the attachment mechanism includes a hook-and-loop type fastening material.

11. The undergarment of claim 8 wherein the attachment mechanism includes at least one elastic band fixed to the fabric web, between which the bottom strap of each gusset web is frictionally retained.

12. The undergarment of claim 1 wherein the fabric web includes two opposing thigh adjustment straps that each include a loop and a hook-and-loop type fastening material, each thigh adjustment strap fixed with the fabric web at side thigh areas thereof opposite the leg aperture from the apex of the inseam, whereby a size of each side thigh area may be adjusted.

13. An undergarment for a human male wearer, comprising:

a fabric web having a top edge, a bottom edge, two opposing inseam edges meeting at an apex, and two opposing side edges, the top edge curved at a curved portion downwardly towards the bottom edge at each of the side edges to form an open frontal area having two upper corners; each side edge sewn to one of the inseam edges to form a leg aperture;

a first gusset web and a second gusset web, each having a top edge, an elongated bottom strap with two opposing bottom strap side edges and a bottom strap distal end, and two side edges each defining an upper corner at the top edge, the upper corners of each gusset web fixed with the upper corners of the fabric web to form a continuous waist aperture, one side edge of each gusset web fixed with one of the inseam edges of the fabric web, the opposing side edge left unattached, the unattached side edges of the first and second gusset webs being opposite each other and curved inwardly; the bottom strap distal end of each gusset web mutually affixed to the fabric web proximate the apex;

an elastic waistband fixed around the waist aperture;

a leg hem fixed around each leg aperture;

the bottom strap distal end of each gusset web mutually and adjustably affixed to the fabric web proximate the apex of the fabric web with an attachment mechanism, proximate the wearer's perineum, wherein the attachment mechanism includes a mechanical snap fastener, a hook-and-loop type fastening material, or at least one elastic band fixed to the fabric web, between which the bottom strap of each gusset web is frictionally retained;

the elastic waistband includes a waist adjustment strap that includes a loop and a hook-and-loop type fastening material, whereby a size of the waist aperture may be adjusted;

each leg hem includes a leg adjustment strap that includes a loop and a hook-and-loop type fastening material, whereby a size of each leg aperture may be adjusted;

the fabric web includes two opposing thigh adjustment straps that each include a loop and a hook-and-loop type fastening material, each thigh adjustment strap fixed with the fabric web at side thigh areas thereof opposite the leg aperture from the apex of the inseam, whereby a size of each side thigh area may be adjusted;

whereby when worn by the wearer, the curved portion of the fabric web isolates the wearer's scrotum from contacting his thighs, the first gusset and the second gusset providing a frontal volume forward of the open frontal area of the fabric web that allows the wearer's genitalia to be unconstrained, and the inclusion of adjustable straps and attachment mechanisms providing a customizable fit to accommodate various body shapes and sizes, enhancing comfort and support.

14. A method of customizing a fit of an undergarment to a human male wearer, comprising the steps:

providing a sizing undergarment that includes a fabric web having a top edge, a bottom edge, two opposing inseam edges meeting at an apex, and two opposing side edges, the top edge curved at a curved portion downwardly towards the bottom edge at each of the side edges to form an open frontal area having two upper corners; each side edge sewn to one of the inseam edges to form a leg aperture; a first gusset web and a second gusset web, each having a top edge, an elongated bottom strap with two opposing bottom strap side edges and a bottom strap distal end, and two side edges each defining an upper corner at the top edge, the upper corners of each gusset web fixed with the upper corners of the fabric web to form a continuous waist aperture, one side edge of each gusset web fixed with one of the inseam edges of the fabric web, the opposing side edge left unattached, the unattached side edges of the first and second gusset webs being opposite each other and curved inwardly; the bottom strap distal end of each gusset web mutually affixed to the fabric web proximate the apex; an elastic waistband fixed around the waist aperture; a leg hem fixed around each leg aperture; the bottom strap distal end of each gusset web mutually and adjustably affixed to the fabric web proximate the apex of the fabric web with an attachment mechanism, proximate the wearer's perineum, wherein the attachment mechanism includes a mechanical snap fastener, a hook-and-loop type fastening material, or at least one elastic band fixed to the fabric web, between which the bottom strap of each gusset web is frictionally retained; the elastic waistband including a waist adjustment strap that includes a loop and a hook-and-loop type fastening material, whereby a size of the waist aperture may be adjusted; each leg hem including a leg adjustment strap that includes a loop and a hook-and-loop type fastening material, whereby a size of each leg aperture may be adjusted; the fabric web including two opposing thigh adjustment straps that each include a loop and a hook-and-loop type fastening material, each thigh adjustment strap fixed with the fabric web at side thigh areas thereof opposite the leg aperture from the apex of the inseam, whereby a size of each side thigh area may be adjusted;

the wearer donning the sizing undergarment and adjusting the attachment mechanism, the waist adjustment strap, the leg adjustment straps, and the thigh adjustment straps for a proper fit;

using the adjustments on the attachment mechanism, the waist adjustment strap, the leg adjustment straps, and the thigh adjustment straps of the sizing undergarment to customize the undergarment for the wearer, comprising: the fabric web having the top edge, the bottom edge, the two opposing inseam edges meeting at the apex, and the two opposing side edges, the top edge curved at the curved portion downwardly towards the bottom edge at each of the side edges to form the open frontal area having two upper corners; each side edge sewn to one of the inseam edges to form the leg aperture; the first gusset web having the first gusset top edge, the first gusset elongated bottom strap having the two opposing bottom strap side edges and the bottom strap distal end, and the two first gusset side edges each defining the upper corner at the first gusset top edge, the upper corners of the first gusset web each fixed with one of the upper corners of the fabric web to form the continuous waist aperture, one of the first gusset side edges fixed with one of the inseam edges of the fabric web, the opposing first gusset side edge left unattached; the second gusset web having the second gusset top edge, the second gusset elongated bottom strap having the two opposing bottom strap side edges and the bottom strap distal end, and the two second gusset side edges each defining the upper corner at the second gusset top edge, the upper corners of the second gusset web each fixed with one of the upper corners of the fabric web and the first gusset web as part of the continuous waist aperture, one of the second gusset side edges fixed with one of the inseam edges of the fabric web, the opposing second gusset side edge left unattached, the unattached first gusset side edge being opposite the unattached second gusset side edge; the bottom strap distal end of each gusset web mutually affixed to the fabric web proximate the apex of the fabric web; the elastic waistband fixed around the waist aperture; a flexible hem fixed around each leg aperture; the unattached side edge of each gusset web curved inwardly; whereby when worn by the wearer, the curved portion of the fabric web isolate the wearer's scrotum from contacting his thighs, the first gusset and the second gusset providing a frontal volume forward of the open frontal area of the fabric web that allows the wearer's genitalia to be unconstrained.

* * * * *